US006422935B1

(12) United States Patent
Yampolski

(10) Patent No.: US 6,422,935 B1
(45) Date of Patent: Jul. 23, 2002

(54) AIR VENT COVERING ASSEMBLY

(76) Inventor: Yuri Yampolski, 3837 Talias Crescent, Mississauga, Ontario (CA), L5M 6L6

( * ) Notice: Subject to any disclaimer, the term of this patent is extended or adjusted under 35 U.S.C. 154(b) by 0 days.

(21) Appl. No.: 09/988,872

(22) Filed: Nov. 21, 2001

(51) Int. Cl.[7] ..... F24F 7/00
(52) U.S. Cl. ..... 454/289; 454/290
(58) Field of Search ..... 454/270, 275, 454/289, 290

(56) References Cited

U.S. PATENT DOCUMENTS 3,391,629 A * 7/1968 Snell ..... 454/290
5,312,298 A 5/1994 Myers
5,597,392 A * 1/1997 Hawkins et al. ..... 422/123
5,643,081 A 7/1997 Klein
5,984,776 A * 11/1999 Berger ..... 454/290
6,012,260 A 1/2000 Hendrick et al.
6,033,304 A * 3/2000 Haynes ..... 454/290
6,066,044 A 5/2000 Orendorff
6,227,962 B1 5/2001 Orendorff
6,241,794 B1 6/2001 Jadran et al.
6,322,442 B1 * 11/2001 Cordell ..... 454/290

* cited by examiner

*Primary Examiner*—Harold Joyce
*Assistant Examiner*—Derek S. Boles
(74) *Attorney, Agent, or Firm*—Marks & Clerk

(57) ABSTRACT

An air vent covering assembly is provided which is adapted to be mounted to a floor, in the peripheral region of an air vent opening therethrough. The air vent covering assembly comprises a cover plate, abase, at least one damper plate, and first and second brackets. The cover plate and base have a plurality of spaced-apart and substantially parallel louvers formed therein, and each of the plurality of louvers defines an edge of a space. Each of the at least one damper plate includes a plurality of spaced-apart and substantially parallel damper bars, and the number of damper bars is equal to the number of louvers provided. When the damper plate is in an open position, flow of air through the spaces defined by the plurality of louvers is allowed, and when the damper plate is in a closed position, flow of air through the spaces is precluded.

9 Claims, 3 Drawing Sheets

AIR VENT COVERING ASSEMBLY

FIELD OF THE INVENTION

This invention relates to vent covering assembly, and particularly relates to air vent covering assembly, which is adapted to be mounted to a floor, in the peripheral region of an air vent opening therethrough. The air vent covering assembly of the present invention is designed in such a manner that flow of air passing through the air vent covering assembly may be regulated.

BACKGROUND OF THE INVENTION

The use of air vent covering assemblies has, of course, been known for many years. They are commonly found in building structures to cover duct openings in the floor, wall or ceiling of a room. The duct openings are, in many instances, part of the heating and ventilation systems.

Typically, air vent covering assemblies are used for aesthetic reasons. The cover plate of the air vent covering may be constructed from materials chosen from such group of materials consisting of wood, metals or plastics. Thus, builders or home owners may choose the desired color or design of a cover plate to match the color of the floor, wall, or ceiling.

At the same time, air vent covering assemblies are employed due to safety reasons. Particularly, in the case of a duct opening in the floor, air vent covering assemblies are used to prevent objects to be fallen into the duct openings, and most importantly, to prevent people from stepping into the duct openings.

The field of air vent covering assembly is a crowded art and encompasses a wide variety of differing embodiments. In general, an air vent covering assembly comprises a cover plate, a plurality of louvers, and a damper mechanism for regulating the flow of air through the spaces defined by the plurality of louvers. Typically, but not necessarily, the air vent covering assembly may also include a filter, so as to remove dust and particulate matter in the air from the heating and ventilation system. The filter is replaceable so as to ensure that no excess particulate matter becomes clogged within the filter over a long period of time.

The air vent covering assembly provided by the present inventor comprises a cover plate, a base, at least one damper plate, and first and second brackets having at least a top channel member. The cover plate has a perimeter which is greater than the perimeter of the base, so as to form a flange extending outwardly beyond the perimeter of the base, at each side and end thereof. When the air vent covering assembly is mounted to a floor, in the peripheral region of an air vent opening, the bottom surface of the cover plate, in the region of the flanges, overlies the floor on which the air vent covering assembly is placed. In the air vent covering assembly of the present invention, the cover plate and the base also have a plurality of spaced-apart and substantially parallel louvers formed therein, in which each of the plurality of louvers defines an edge of a space. Furthermore, each of the at least one damper plate includes a plurality of spaced-apart and substantially parallel damper bars, and is such that the number of damper bars is equal to the number of louvers provided. Still further, each of the at least one damper plate has an actuator arm secured thereto, which allows the user to open or close the damper plate. When the damper plate is in an open position, flow of air through the spaces defined by the plurality of louvers is allowed, and when the damper plate is in a closed position, flow of air through the spaces defined by the plurality of louvers is precluded.

DESCRIPTION OF THE PRIOR ART

Several typical prior art vent covers are now described. They include JADRAN et al. U.S. Pat. No. 6,241,794 B1, published Jun. 5, 2001, which teaches a minivent air filter for filtering air passing through a vent in a force air system. The minivent air filter includes a vent cover and a tubular vent sleeve in communication with the vent cover. The vent sleeve has a elongate slot in which a filter is inserted. A pair of support rails are disposed in the vent sleeve below the elongate slot. There is no mechanism to allow the user to adjust the opening and closing of the louvers which extend across the upper opening of the vent cover to regulate the passage of air flow.

In U.S. Pat. No. 5,984,776 issued Nov. 16, 1999, the inventor BERGER has provided a register assembly for covering an air duct opening. The register assembly comprises a faceplate, a base, a damper mechanism and a filter frame that are removably secured one to another. The faceplate is replaceable, allowing the use of various ornamental designs of the faceplate grid on the same base containing the damper mechanism and filter frame.

In another U.S. Pat. No. 6,012,260 issued to HENDRICK et al., the inventors teach an air vent insert for mounting to the perimeter of a vent opening in a building structure. The air vent insert has threaded mounting holes for securing an air vent cover. The insert includes an open frame having front and back faces, generally rectangular inner and outer perimeter edges, a spaced apart pair of elongate side members extending between the end members. The inner perimeter edge of the frame defines a central opening. The frame is designed for mounting to a building structure around the periphery of an air vent opening in the building structure such that the center opening of the frame extends around the outer periphery of the air vent opening in the building structure. Accordingly, when the air vent cover is mounted to the air vent insert, the air vent cover substantially covers the central opening.

In U.S. Pat. No. 6,066,044 issued May 23, 2000 to ORENDORFF, the inventor has provided a vent assembly having a vent cover which is detachably mounted to a damper housing. Particularly, the invention is directed to couplers which are mounted to the damper housing, each having a catch portion which is inserted into a respective air flow slot of the vent cover to engage the vent cover and couple these components together. The couplers may be constructed to permit flexing of the couplers during the insertion process, with the couplers being biased to engage the vent cover when no longer flexed. A filter housing may also be detachably coupled to the damper housing such that a filter may be inserted therethrough.

In yet another U.S. Pat. No. 6,227,962 B1 published May 8, 2001, the above inventor ORENDORFF teaches a vent coupler which has first and second leg portions and a latch element extending between the leg portions. The coupler may be formed from a single piece of wire and be detachably coupled to a vent damper. The latch element is inserted into a respective air flow slot of a vent cover to engage the vent cover and couple the vent cover to the damper.

U.S. Pat. No. 5,643,081 issued Jul. 1, 1997, the inventor KLEIN teaches a vent screen and vent apparatus including a vent duct along with an exterior grill connected to one end of the vent duct. The exterior grill includes a screen access opening. A vent screen support assembly is connected to the vent duct between the vent duct and the exterior grill. The vent screen support assembly further includes a transverse screen supporting track which is supported by the vent duct and a longitudinal screen supporting track connected to the transverse screen support portion. A vent screen is installed through the screen access opening and is supported by the vent screen support assembly. The exterior grill includes a plurality of grill slats. An adjustable vane assembly is supported by the vent duct, and a manually operated vane adjustment handle is connected to the adjustable vane assembly for adjusting the adjustable vane assembly.

Finally, MYERS U.S. Pat. No. 5,312,298 issued May 17, 1994 teaches floor vents for alternately supplying air to a conditioned space. When the floor vents are used in combination with a heating or cooling system, the delivery of air in a desired direction is facilitated. Louvers with integrally formed gears are pivotally mounted between ends of the vent, and are repositioned by a thumbwheel located below the upper surface of the grille portion of the vent. Additionally, the louvers are provided with integrally formed bushings and rotatable end elements to enhance rotation and reliability.

SUMMARY OF THE INVENTION

In accordance with one aspect of the present invention, there is provided an air vent covering assembly which is adapted to be mounted to a floor, in the peripheral region of an air vent opening therethrough.

The air vent covering assembly comprises a cover plate having top and bottom surfaces, first and second end walls, and first and second side walls, at least one damper plate having top and bottom surfaces, first and second brackets, each having inner and outer surfaces, and at least a top channel members. The first and second brackets are respectively positioned along the first and second side walls of the base.

Generally, the bottom surface of the cover plate is contiguous to the top surface of the base.

The cover plate has a perimeter which is greater than the perimeter of the base, so as to form a flange extending outwardly beyond the perimeter of the base, at each side and end thereof. When the air vent covering assembly is mounted to a floor, in the peripheral region of an air vent opening, the bottom surface of the cover plate, in the region of the flanges, overlies the floor on which the air vent covering assembly is placed.

The cover plate and the base have a plurality of spaced-apart and substantially parallel louvers formed therein, and the plurality of louvers extends downwardly from the top surface of the cover plate to the bottom surface of the base.

Each of the plurality of louvers defines an edge of a space, and the space extends from the top surface of the cover plate to the bottom surface of the base. Furthermore, each of the spaces has first and second edges. The first edge of each space is located in the region directed to the first end of the cover plate, and the second edge of each space is located in the region directed to the second end of the cover plate.

The top surface of the at least one damper plate is contiguous to the bottom surface of the base, and the at least one damper plate and the base are framed by the top channel members of each of the first and second brackets such that the inner surface of each of the first and second brackets is contiguous to the respective first and second side walls of the base.

Typically, each of the at least one damper plate has an actuator arm secured thereto. The actuator arm extends upwardly through a space which is defined at least at one side by one of the plurality of louvers, and the movement of the actuator arm is restricted by the distance between the first and second edges of the space.

Each of the at least one damper plate includes a plurality of spaced-apart and substantially parallel damper bars. The number of the damper bars is equal to the number of the louvers provided.

Each of the plurality of damper bars has first and second edges, and the distance between the first and second edges of each of the plurality of damper bars is at least as great as the distance between the first and second edges of each of the spaces defined by each of the plurality of louvers.

When the damper plate is in an open position, flow of air through the spaces defined by the plurality of louvers is allowed, and when the damper plate is in a closed position, flow of air through the spaces defined by the plurality of louvers is precluded.

In keeping with one aspect of the present invention, each of the first and second brackets of the air vent covering assembly may further comprise a bottom channel member.

Typically, but not necessarily, the air vent covering assembly may further comprise a filter, and the filter is framed by the bottom channel members of each of the first and second brackets.

The filter is formed from materials chosen from the group of materials consisting of open-cell foam, woven natural fibres, woven synthetic fibres, non-woven natural fibres, non-woven synthetic fibres, cellulose, polyethylene, polyurethane, and combinations and mixtures thereof.

The cover plate is formed from materials chosen from the group of materials consisting of wood, metals, or plastics.

In another embodiment of the present invention, the plurality of louvers includes a first set of louvers, and a second set of louvers. The first set of louvers extends downwardly from the top surface of the cover plate to the bottom surface of the base, and is angled away relative to the first end of the cover plate. The second set of louvers extends downwardly from the top surface of the cover plate to the bottom surface of the base, and is angled away relative to the second end of the cover plate.

The air vent covering assembly may comprise a first damper plate and a second damper plate. The top surface of the first damper plate is contiguous to the bottom surface of the base, in the region of the first set of louvers, and the top surface of the second damper plate is contiguous to the bottom surface of the base, in the region of the second set of louvers.

Each of the first and second damper plates includes a plurality of spaced-apart and substantially parallel damper bars. The number of the damper bars in the first damper plate is equal to the number of the louvers provided in the first set of louvers, and the number of the damper bars in the second damper plate is equal to the number of louvers provided in the second set of louvers.

In keeping with the present invention, each of the first and second damper plates has an actuator arm secured thereto.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
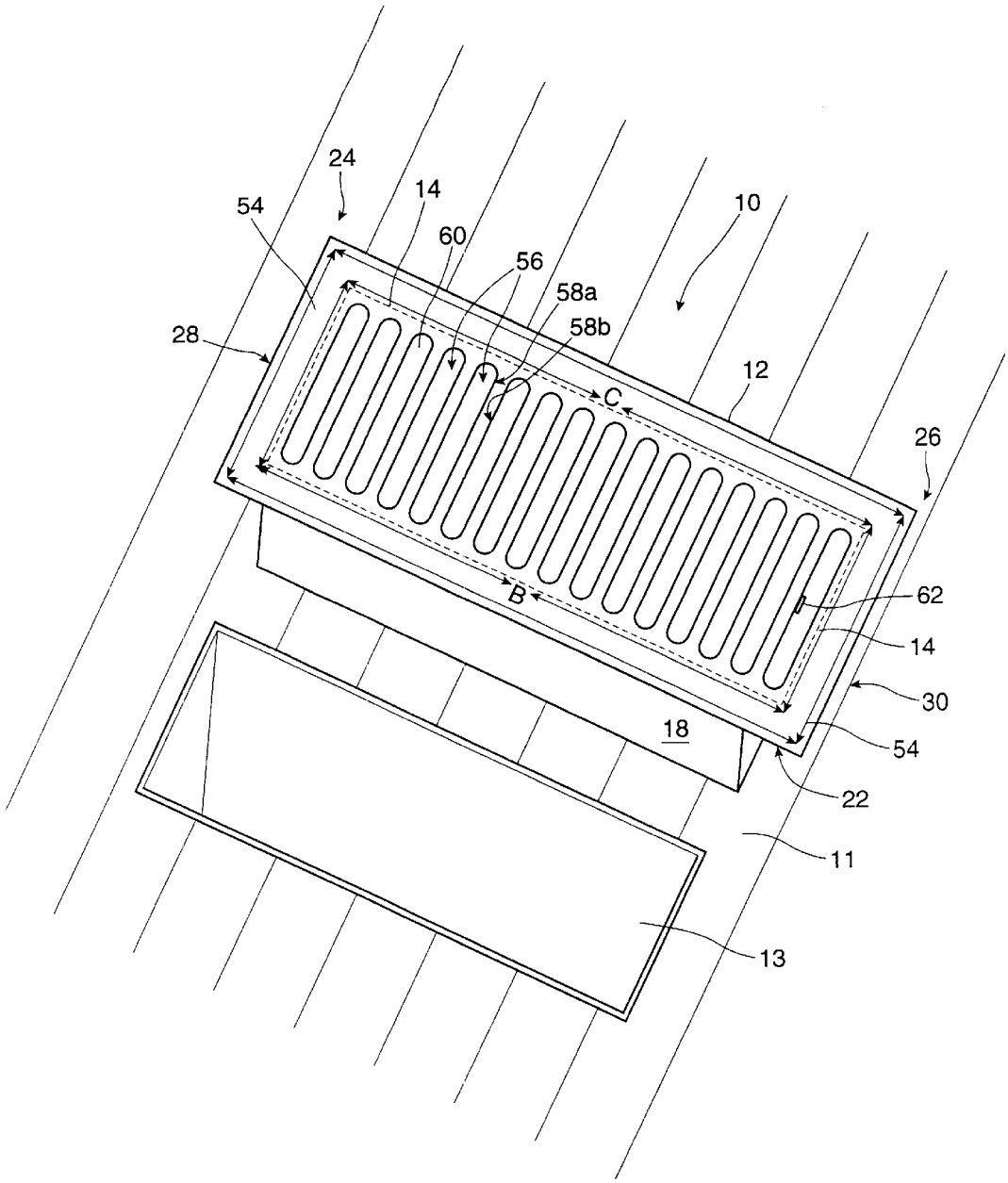
FIG. 1 a perspective view of a first embodiment of the air vent covering assembly of the present invention being mounted to a floor, in the peripheral region of an air vent opening therethrough.

The novel features which are believed to be characteristic of the present invention, as to its structure, organization, use and method of operation, together with further objectives and advantages thereof, will be better understood from the following discussion.

As noted above, a feature of the present invention is essentially to provide an air vent covering assembly which is adapted to be mounted to a floor, in the peripheral region of an air vent opening therethrough. The air vent covering assembly of the present invention is designed in such a manner that flow of air passing through the air vent covering assembly may be regulated.

Turning first to FIGS. 1 to 4, a first embodiment of an air vent covering assembly 10 is shown. The air vent covering assembly 10 comprises a cover plate 12, a base 14, at least one damper plate 16, and first and second brackets 18*a* and 18*b* respectively.

The cover plate 12 has top and bottom surfaces 20 and 22, first and second ends 24 and 26, and first and second side edges 28 and 30. The base 14 has top and bottom surfaces 32 and 34, first and second end walls 36 and 38, and first and second side walls 40 and 42. The at least one damper plate 16 has top and bottom surfaces 44 and 46.

Each of the first and second brackets 18*a* and 18*b* has inner and outer surfaces 48 and 50, and at least atop channel member 52. The first and second brackets 18*a* and 18*b* are respectively positioned along the first and second side walls 40 and 42 of the base 14.

The bottom surface 22 of the cover plate 12 is contiguous to the top surface 32 of the base 14. As described herein, the cover plate 12 and the base 14 are treated as separate entities; however, the cover plate 12 and the base 14 may also be manufactured together in one single piece.

The cover plate 12 has a perimeter C which is greater than the perimeter B of the base 14, so as to form a flange 54 extending outwardly beyond the perimeter B of the base, at each side 40 and 42, and end 36 and 38 thereof. As best seen in FIG. 1, when the air vent covering assembly 10 is mounted to a floor 11, in the peripheral region of an air vent opening 13, the bottom surface 22 of the cover plate 12, in the region of the flanges 54, overlies the floor 11 on which the air vent covering assembly 10 is placed.

Figure 2:
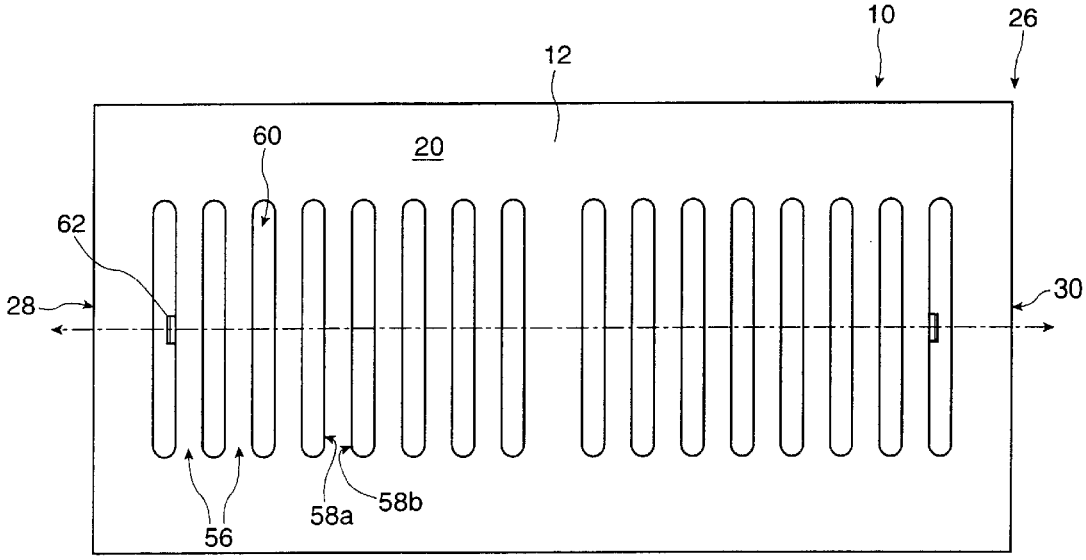
FIG. 2 is a top view of a first embodiment of the air vent covering assembly of the present invention.

The cover plate 12 and the base 14 have a plurality of spaced-apart and substantially parallel louvers 56 formed therein, and the plurality of louvers 56 extends downwardly from the top surface 20 of the cover plate 12 to the bottom surface 34 of the base 14. Furthermore, each of the plurality of louvers 56 defines an edge 58 of a space 60. The space 60 extends from the top surface of the cover plate 12 to the bottom surface 34 of the base 14. Each of the spaces 60 has first and second edges 58*a* and 58*b* respectively. With reference to FIG. 2, the first edge 58*a* of each space 60 is located in the region direct to the first end 24 of the cover plate 12, and the second edge 58*b* of each space 60 is located in the region directed to the second end 26 of the cover plate 12.

Figure 4:
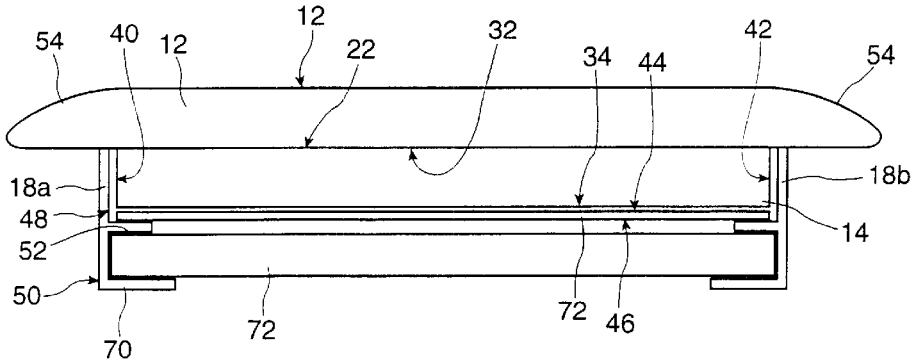
FIG. 4 is a end view of a first embodiment of the air vent covering assembly of the present invention.

Turning to FIG. 4, the top surface 44 of the at least one damper plate 16 is contiguous to the bottom surface 34 of the base 14. The at least one damper plate 16 and the base 14 are framed by the top channel members 52 of each of the first and second brackets 18*a* and 18*b* respectively such that the inner surface 48 of each of the first and second brackets 18*a* and 18*b* is contiguous to the respective first and second side walls 40 and 42 respectively of the base 14.

Figure 3:
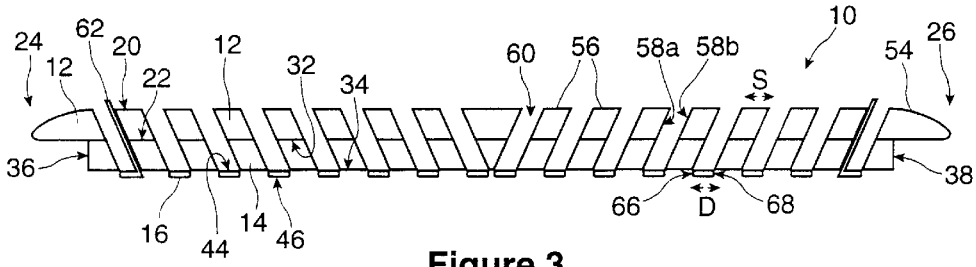
FIG. 3 is a side cross-sectional view of a first embodiment of the air vent covering assembly of the present invention.

In order to facilitate lateral movement of each of the at least one damper plate 16 of the air vent covering assembly 10 of the present invention, each of the at least one damper plate 16 has an actuator arm 62 secured thereto, as best seen in FIG. 3. The actuator arm 62 extends upwardly through a space 60 which is defined at least at one side by one of the plurality of louvers 56. In the embodiment shown in FIGS. 2 to 4, the actuator arm 62 extends upwardly through a space 60 which is located in the end region of the cover plate 12. The movement of the actuator arm 62 is restricted by the distance between the first and second edges 58*a* and 58*b* respectively of the space 60.

Each of the at least one damper plate 16 includes a plurality of spaced-apart and substantially parallel damper bars 64. The number of damper bars 64 is equal to the number of the louvers 56 provided.

Moreover, each of the plurality of damper bars 64 has first and second edges 66 and 68, and the distance D between the first and second edges 66 and 68 respectively of each of the plurality of damper bars 64 is at least as great as the distance S between the first and second edges 58*a* and 58*b* of each of the spaces 60 defined by each of the plurality of louvers 56.

Figure 6:
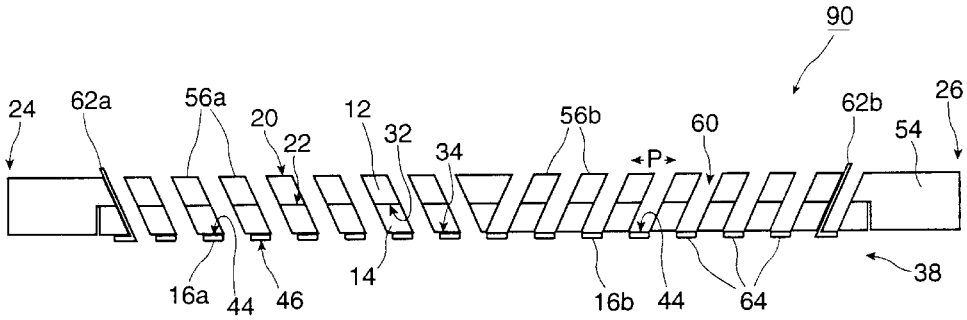
FIG. 6 is a side cross-sectional view of a second embodiment of the air vent covering assembly of the present invention having two damper plates, with the first damper plate in an open position, and the second damper plate in a closed position.

With reference to FIG. 6, when the damper plate 16 is in an open position, flow of air through the spaces 60 defined by the plurality of louvers 56 is allowed, and when the damper plate 16 is in a closed position, flow of air through the spaces 60 defined by the plurality of louvers 56 is precluded.

Typically, but not necessarily, each of the first and second brackets 18*a* and 18*b* may further comprise a bottom channel member 70. Moreover, the air vent covering assembly 10 of the present invention may further comprise a filter 72. As is shown in FIG. 4, the filter 72 is framed by the bottom channel members 70 of each of the first and second brackets 18*a* and 18*b*.

Generally, the filter 72 is formed from materials chosen from the group of materials consisting of open-cell foam, woven natural fibres, woven synthetic fibres, non-woven natural fibres, non-woven synthetic fibres, cellulose, polyethylene, polyurethane, and combinations and mixtures thereof. The purpose of using a filter 72 is to remove dust and particulate matter in the passing air from the heating and ventilation system. The filter 72 is replaceable so as to ensure that no excess particulate matter becomes clogged within the filter 72 over a long period of time.

The cover plate 12 is formed from materials chosen from the group of materials consisting of wood, metals, or plastics. Indeed, the builders or home owners may choose the desired color or design of a cover plate 12 to match the color of the floor, wall, or ceiling.

Figure 5:
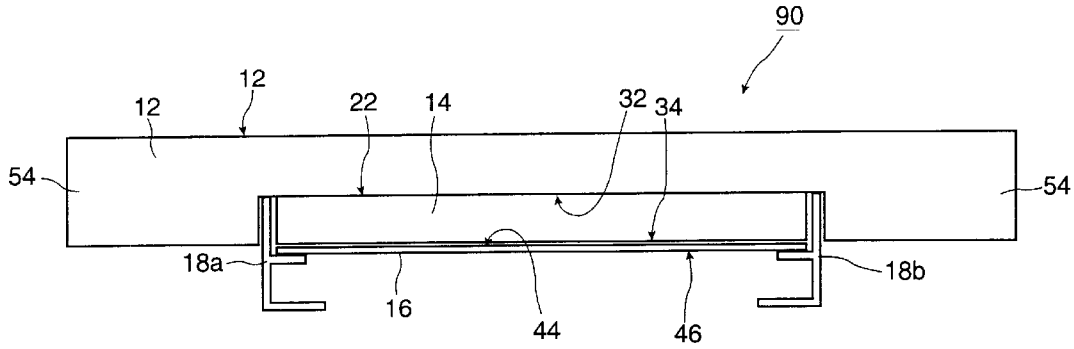
FIG. 5 is an end view of a second embodiment of the air vent covering assembly of the present invention.

A second embodiment of the air vent covering assembly 90 of the present invention is shown in FIG. 5. The air vent covering assembly 90 generally has the same structural configurations as the air vent covering assembly 10 which was described above. However, the plurality of louvers 56 of the air vent covering assembly 90 includes a first set of louvers 56*a* and 56*b*. The first set of louvers 56*a* extends downwardly from the top surface 20 of the cover plate 12 to the bottom surface 34 of the base 14, and is angled away relative to the first end 24 of the cover plate 12. The second set of louvers 56*b* extends downwardly from the top surface 20 of the cover plate 12 to the bottom surface 34 of the base 14, and is angled away relative to the second end 26 of the cover plate 12.

The air vent covering assembly 90 shown in FIG. 5 also comprises a first damper plate 16*a* and a second damper plate 16*b*. The top surface 44 of the first damper plate 16*a* is contiguous to the bottom surface 34 of the base 14, in the region of the first set of louvers 56*a*.

Still further, each of the first and second damper plates 16*a* and 16*b* respectively, includes a plurality of spaced-apart and substantially parallel damper bars 64. It is important to note that the number of damper bars 64 in the first damper plate 16*a* is equal to the number of louvers 56 provided in the first set of the louvers 56*a,* and that the number of damper bars 64 in the second damper plate 16*b* is equal to the number of louvers 56 provided in the second set of the louvers 56*b*.

In accordance with the present invention, each of the first and second damper plates 16*a* and 16*b* has an actuator arm 62 secured thereto. The actuator arms 62*a* and 62*b* permit lateral movement of the respective first and second damper plates 16*a* and 16*b*. In FIG. 6, the first damper plate 16*a* is shown in the open position and the second damper plate 16*b* is shown in the closed position. Thus, in this case, flow of air through the spaces 60 defined by the first set of louvers 56*a* is allowed, whereas flow of air through the spaces 60 defined by the second set of louvers 56*b* is precluded.

Although each of the air vent covering assemblies 10 and 90 shown in FIGS. 1 through 6 has eight spaces 60 which span across the cover plate 12, other sizes are also possible, depending on the size of the duct opening. It is also important to note that the size of each of the spaces 60 defined by the plurality of louvers 56 is not limiting; however a common pitch distance P may be in the range between 11 to 20 millimetres.

Other modifications and alterations maybe used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. An air vent covering assembly which is mountable to a floor, in the peripheral region of an air vent opening therethrough, said air vent covering assembly comprising:

a cover plate having top and bottom surfaces, first and second ends, and first and second side edges;

a base having top and bottom surfaces, first and second end walls, and first and second side walls;

at least one damper plate having top and bottom surfaces;

first and second brackets, each having inner and outer surfaces, and at least a top channel member; said first and second brackets being respectively positioned along said first and second side walls of said base;

wherein said bottom surface of said cover plate is contiguous to said top surface of said base;

wherein said cover plate has a perimeter which is greater than the perimeter of said base, so as to form a flange extending outwardly beyond the perimeter of said base, at each side and end thereof, whereby when said air vent covering assembly is mounted to a floor, in the peripheral region of an air vent opening, said bottom surface of said cover plate, in the region of said flanges, overlies the floor on which said air vent covering assembly is placed, wherein said cover plate and said base have a plurality of spaced apart and substantially parallel louvers formed therein, and wherein said plurality of louvers extends downwardly from said top surface of said cover plate to said bottom surface of said base;

wherein each of said plurality of louvers defines an edge of a space, wherein said space extends from said top surface of said cover plate to said bottom surface of said base;

wherein each of said spaces has first and second edges, wherein said first edge of each said space is located in the region directed to said first end of said cover plate, and wherein said second edge of each said space is located in the region directed to said second end of said cover plate;

wherein said top surface of said at least one damper plate is contiguous to said bottom surface of said base, and wherein said at least one damper plate and said base are framed by said top channel members of each of said first and second brackets such that said inner surface of each of said first and second brackets is contiguous to said respective first and second side walls of said base;

wherein each of said at least one damper plate has an actuator arm secured thereto;

wherein said actuator arm extends upwardly through a space which is defined at least at one side by one of said plurality of louvers, and wherein movement of said actuator arm is restricted by the distance between said first and second edges of said space;

wherein each of said at least one damper plate includes a plurality of spaced-apart and substantially parallel damper bars, and wherein the number of said damper bars is equal to the number of said louvers provided;

wherein each of said plurality of damper bars has first and second edges, and wherein the distance between said first and second edges of each of said plurality of damper bars is at least as great as the distance between said first and second edges of each of said spaces defined by each of said plurality of louvers, and wherein when said damper plate is in an open position, flow of air through said spaces defined by said plurality of louvers is allowed, and wherein when said damper plate is in a closed position, flow of air through said spaces defined by said plurality of louvers is precluded.

2. The air vent covering assembly of claim 1, wherein each of said first and second brackets further comprises a bottom channel member.

3. The air vent covering assembly of claim 2, further comprising a filter, wherein said filter is framed by said bottom channel members of each of said first and second brackets.

4. The air vent covering assembly of claim 3, wherein said filter is formed from materials chosen from the group of materials consisting of open-cell foam, woven natural fibres, woven synthetic fibres, non-woven natural fibres, non-woven synthetic fibres, cellulose, polyethylene, polyurethane, and combinations and mixtures thereof.

5. The air vent covering assembly of claim 1, wherein said cover plate is formed from materials chosen from the group of materials consisting of wood, metals, or plastics.

6. The air vent covering assembly of claim 1, wherein said plurality of louvers includes a first set of said louvers, and a second set of said louvers, wherein said first set of louvers extends downwardly from said top surface of said cover plate to said bottom surface of said base, and is angled away relative to said first end of said cover plate, and wherein said second set of louvers extends downwardly from said top surface of said cover plate to said bottom surface of said base, and is angled away relative to said second end of said cover plate.

7. The air vent covering assembly of claim 6, wherein said air vent covering assembly comprises a first damper plate and a second damper plate, wherein said top surface of said first damper plate is contiguous to said bottom surface of said base, in the region of said first set of said louvers, and wherein said top surface of said second damper plate is contiguous to said bottom surface of said base, in the region of said second set of said louvers.

8. The air vent covering assembly of claim 7, wherein each of said first and second damper plates includes a plurality of spaced-apart and substantially parallel damper bars, wherein the number of said damper bars in said first damper plate is equal to the number of said louvers provided in said first set of said louvers, and wherein the number of said damper bars in said second damper plate is equal to the number of said louvers provided in said second set of said louvers.

9. The air vent covering assembly of claim 7, wherein each of said first and second damper plates has an actuator arm secured thereto.

* * * * *